US008919115B2

(12) United States Patent
Hagiwara et al.

(10) Patent No.: US 8,919,115 B2
(45) Date of Patent: Dec. 30, 2014

(54) HYDRAULIC DRIVE DEVICE FOR HYDRAULIC EXCAVATOR

(75) Inventors: Naoki Hagiwara, Tsuchiura (JP); Yasuo Okano, Tsuchiura (JP); Tsuyoshi Nakamura, Tsuchiura (JP); Kouji Ishikawa, Tsuchiura (JP); Kazunori Nakamura, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 865 days.

(21) Appl. No.: 13/023,789

(22) Filed: Feb. 9, 2011

(65) Prior Publication Data

US 2011/0192155 A1 Aug. 11, 2011

(30) Foreign Application Priority Data

Feb. 10, 2010 (JP) ..... 2010-028015

(51) Int. Cl.
*F15B 11/04* (2006.01)
*E02F 9/22* (2006.01)

(52) U.S. Cl.
CPC ..... *E02F 9/2239* (2013.01); *E02F 9/2242* (2013.01); *E02F 9/2285* (2013.01); *E02F 9/2292* (2013.01); *E02F 9/2296* (2013.01); *F15B 2211/20576* (2013.01); *F15B 2211/30565* (2013.01); *F15B 2211/40515* (2013.01); *F15B 2211/415* (2013.01); *F15B 2211/428* (2013.01); *F15B 2211/7142* (2013.01); *F15B 2211/781* (2013.01)
USPC ..... 60/426; 60/422; 91/513; 91/517

(58) Field of Classification Search
CPC .... F15B 11/0413; F15B 11/042; F15B 11/17; F15B 2211/40515; F15B 2211/781
USPC ..... 60/421, 422, 426; 91/513, 516, 517; 37/348; 701/50
See application file for complete search history.

(56) References Cited

U.S. PATENT DOCUMENTS 1,980,674 A * 11/1934 Folmsbee ..... 62/461
5,433,076 A * 7/1995 Sugiyama et al. ..... 60/426

(Continued)

FOREIGN PATENT DOCUMENTS

CN 1824895 A 8/2006
CN 101481918 A 7/2009

(Continued)

OTHER PUBLICATIONS

Extended European Search Report dated Jan. 25, 2012 (seven (7) pages).

(Continued)

*Primary Examiner* — F. Daniel Lopez
(74) *Attorney, Agent, or Firm* — Crowell & Moring LLP

(57) ABSTRACT

The operability when performing a combined arm-crowd and bucket operation can be improved. A hydraulic drive device for a hydraulic excavator includes: a bucket directional control valve and a second arm directional control valve, which are connected in parallel tandem with a first hydraulic pump; a first arm directional control valve that is connected to a second hydraulic pump; and a flow rate restriction device that restricts the flow rate of pressure oil supplied to the second arm directional control valve, during crowd operation of a bucket. This flow rate restriction device includes a variable throttle whose opening is controlled so as to become smaller as a bucket operating device is operated to the crowd side, the variable throttle being provided in a bypass path connecting to the supply port of the second arm directional control valve.

4 Claims, 4 Drawing Sheets

(56) References Cited

U.S. PATENT DOCUMENTS

| | | | | | |
|---|---|---|---|---|---|
| 5,479,778 | A | * | 1/1996 | Toyooka et al. | 60/431 |
| 5,584,227 | A | * | 12/1996 | Chung | 91/532 |
| 5,615,991 | A | * | 4/1997 | Chung | 414/685 |
| 5,680,759 | A | * | 10/1997 | Chung | 60/421 |
| 5,813,311 | A | * | 9/1998 | Toyooka et al. | 91/513 |
| 5,829,252 | A | | 11/1998 | Hirata et al. | |
| 5,890,303 | A | | 4/1999 | Ishikawa et al. | |
| 6,164,069 | A | * | 12/2000 | Takahashi et al. | 60/421 |
| 6,378,303 | B1 | * | 4/2002 | Higuchi et al. | 60/468 |
| 6,430,922 | B2 | * | 8/2002 | Tohji | 60/421 |
| 6,581,506 | B1 | * | 6/2003 | Shimada | 91/513 |
| 6,675,904 | B2 | * | 1/2004 | Joung | 172/2 |
| 7,127,887 | B2 | * | 10/2006 | Nakamura et al. | 60/421 |
| 7,207,175 | B2 | * | 4/2007 | Kim | 60/422 |
| 7,356,991 | B2 | * | 4/2008 | Kim et al. | 60/421 |
| 7,430,859 | B2 | | 10/2008 | Jang et al. | |
| 7,904,224 | B2 | * | 3/2011 | Kanayama et al. | 701/50 |
| 2005/0138924 | A1 | * | 6/2005 | Kodama et al. | 60/456 |

FOREIGN PATENT DOCUMENTS

| | | | | |
|---|---|---|---|---|
| CN | 101573498 | A | | 11/2009 |
| EP | 0 715 029 | A1 | | 6/1996 |
| EP | 0 781 888 | A1 | | 7/1997 |
| EP | 1 416 096 | A1 | | 5/2004 |
| EP | 1 672 127 | A2 | | 6/2006 |
| JP | 60-148366 | | * | 10/1985 |
| JP | 60-148366 | U | | 10/1985 |
| JP | 8-232301 | A | | 9/1996 |
| JP | 3183815 | B2 | | 7/2001 |
| JP | 2004-150198 | A | | 5/2004 |
| JP | 2005-127413 | A | | 5/2005 |
| WO | WO 2008/078930 | A1 | | 7/2008 |

OTHER PUBLICATIONS

Chinese Office Action dated Mar. 3, 2014 (six (6) pages).

* cited by examiner

HYDRAULIC DRIVE DEVICE FOR HYDRAULIC EXCAVATOR

BACKGROUND OF THE INVENTION (1) Field of the Invention

The present invention relates to a hydraulic drive device for a hydraulic excavator that has a front attachment connected to a swing body in a vertically rotatable manner and including an arm and a bucket.

(2) Description of the Related Art

Japanese Patent No. 3183815 discloses a hydraulic drive device which is provided in a hydraulic excavator having a front attachment including a boom, an arm, a bucket, a boom cylinder, an arm cylinder, and a bucket cylinder, and in which a boom directional control valve and a second arm directional control valve are connected in parallel tandem with a first hydraulic pump, and a first arm directional control valve is connected to a second hydraulic pump, the hydraulic drive device including an auxiliary switching valve that restricts the rate of flow supplied to the second arm directional control valve, following an arm roll-in operation (crowd operation).

In this hydraulic drive device according to the related art, the auxiliary switching valve is provided to prevent a situation where, during combined operation of arm roll-in and boom raise, the load pressure on the arm becomes lower than the load pressure on the boom, with the result that pressure oil in the first hydraulic pump is supplied only to the second arm directional control valve and is not supplied to the boom directional control valve. That is, during such a combined operation of arm roll-in and boom raise, the auxiliary switching valve is actuated to constrict the supply passage to the second arm directional control valve and raise the upstream pressure of the second arm directional control valve, thus securing the flow of pressure oil to the boom directional control valve, and pressure oil discharged from the second hydraulic pump is supplied to the first arm directional control valve, thereby performing a desired combined operation of arm roll-in and boom raise.

SUMMARY OF THE INVENTION

When doing a work such as the leveling of soil or excavation of sand, or when doing a work such as rolling for ground compaction with a hydraulic excavator, a combined operation of arm-crowd and bucket-crowd is performed. In such a case, a situation often arises where the load pressure on the arm becomes lower than the load pressure on the bucket, with the result that although pressure oil flows to the arm cylinder, pressure oil does not readily flow to the bucket cylinder side, making smooth driving of the bucket difficult. That is, there are cases where the operability of combined arm-crowd and bucket operation decreases, making it impossible to expect an improvement in working efficiency. The related art described in Japanese Patent No. 3183815 does not disclose any device configuration that can be adapted to such a combined arm-crowd and bucket operation. In actually doing works at a work site, such an improvement in operability in performing such a combined arm-crowd and bucket operation has also been desired.

The present invention has been made in view of the above circumstances in the related art and provides a hydraulic drive device for a hydraulic excavator which can improve operability when performing a combined arm-crowd and bucket operation.

To this end, according to an embodiment of the present invention, there is provided a hydraulic drive device for a hydraulic excavator, which is provided in the hydraulic excavator including a front attachment, the front attachment being connected to a swing body in a vertically rotatable manner and including an arm, a bucket, an arm cylinder, and a bucket cylinder, the hydraulic drive device including an engine, a first hydraulic pump, a second hydraulic pump, and a pilot pump that are driven by the engine, a bucket directional control valve and a second arm directional control valve that are each connected in parallel tandem with the first hydraulic pump, the bucket directional control valve controlling a flow of pressure oil supplied to the bucket cylinder, the second arm directional control valve controlling a flow of pressure oil supplied to the arm cylinder, a first arm directional control valve connected to the second hydraulic pump, and a flow rate restriction device that restricts a flow rate of pressure oil supplied to the second arm directional control valve, during operation of the bucket.

In the embodiment of the present invention configured as described above, during bucket operation, the flow rate of pressure oil supplied to the second arm directional control valve, which is connected in parallel with the first hydraulic pump together with the bucket directional control valve, is restricted by the flow rate restriction device. Therefore, the flow rate of pressure oil supplied to the second arm directional control valve is restricted during combined arm-crowd and bucket operation as well. Thus, pressure oil in the first hydraulic pump tends to be supplied mainly to the bucket directional control valve, and pressure oil in the second hydraulic pump is supplied to the first arm directional control valve. This allows both the arm cylinder and the bucket cylinder to be actuated to achieve smooth driving of the bucket as well as driving of the arm, thereby improving the operability of combined arm-crowd and bucket operation.

According to an embodiment of the present invention, in the hydraulic drive device for a hydraulic excavator according to the above embodiment of the present invention, the hydraulic drive device further includes a bucket operating device that performs a switch operation of the bucket directional control valve, and the flow rate restriction device includes a variable throttle whose opening is controlled to become smaller as the bucket operating device is operated, the variable throttle being provided in a bypass path that connects to a supply port of the second arm directional control valve.

In the embodiment of the present invention configured as described above, during combined arm-crowd and bucket operation, as the bucket operating device is operated, the variable throttle provided in the bypass path connecting to the supply port of the second arm directional control valve is controlled so that its opening becomes smaller. Following this, the bypass path to the second directional control valve becomes high pressure, with the result that pressure oil in the first hydraulic pump is not readily supplied to the second arm directional control valve, and tends to be supplied to the bucket directional control valve. Therefore, pressure oil in the first hydraulic pump is supplied mainly to the bucket directional control valve, and pressure oil in the second hydraulic pump is supplied to the first arm directional control valve, thereby making it possible to perform a combined arm-crowd and bucket operation in a satisfactory manner.

According to an embodiment of the present invention, in the hydraulic drive device for a hydraulic excavator according to the above embodiment of the present invention, the flow rate restriction device includes a passage that guides a pilot pressure supplied from the pilot pump to a control portion of the variable throttle, in accordance with operation of the bucket operating device.

In the embodiment of the present invention configured as described above, during combined arm-crowd and bucket operation, in accordance with operation of the bucket operating device, pilot pressure supplied from the pilot pump is guided to the control portion of the variable throttle via the passage, and the opening of the variable throttle is controlled to become smaller.

According to an embodiment of the present invention, in the hydraulic drive device for a hydraulic excavator according to the above embodiment of the present invention, the flow rate restriction device includes a pressure sensor that detects an amount of operation of the bucket operating device, a controller that determines whether or not the amount of operation detected by the pressure sensor is equal to or larger than a predetermined amount, and outputs an actuation signal for actuating the variable throttle when the amount of operation is equal to or more than the predetermined amount, and an electromagnetic switching valve that is switched to allow communication between the pilot pump and the passage when the actuation signal is outputted from the controller, and is switched to shut off communication between the pilot pump and the passage when the actuation signal is not outputted from the controller.

In the embodiment of the present invention configured as described above, during combined arm-crowd and bucket operation, operation of the bucket operating device is detected by the pressure sensor, and when it is determined by the controller that the amount of the operation has become equal to or larger than a predetermined amount, an actuation signal is outputted to the electromagnetic switching valve from the controller. Thus, pilot pressure supplied from the pilot pump is guided to the control portion of the variable throttle via the electromagnetic switching valve and the passage, and the opening of the variable throttle is controlled to become smaller.

According to an embodiment of the present invention, in the hydraulic drive device for a hydraulic excavator according to the above embodiment of the present invention, the hydraulic drive device further includes a disable control device that performs a control to disable the restriction of the flow rate by the flow rate restriction device when a pressure of pressure oil discharged from the first hydraulic pump becomes a high pressure equal to or higher than a predetermined pressure, during operation of the bucket.

In the embodiment of the present invention configured as described above, during combined arm-crowd and bucket operation, when the load pressure on the bucket rises to a high pressure equal to or higher than a predetermined pressure, for example, a relief pressure, the disable control device is actuated to disable the restriction of flow rate by the flow rate restriction device, in other words, the restriction of the flow rate of pressure oil supplied to the second arm directional control valve, thereby actively permitting the supply of pressure oil to the second arm directional control valve. Consequently, pressure oil in the first hydraulic pump, which has been so far mainly supplied to the bucket directional control valve, is supplied also to the second arm directional control valve, and pressure oil in the first hydraulic pump is supplied to the arm cylinder, thereby achieving effective use of drive energy.

According to an embodiment of the present invention, the hydraulic drive device includes the flow rate restriction device that restricts the flow rate of pressure oil supplied to the second arm directional control valve, which is connected in parallel tandem with the first hydraulic pump together with the bucket directional control valve. Therefore, during combined arm-crowd and bucket operation, by supplying pressure oil in the first hydraulic pump mainly to the bucket directional control valve, and supplying pressure oil in the second hydraulic pump to the first arm directional control valve, the bucket cylinder and the arm cylinder are actuated, thereby making it possible to perform smooth driving of the bucket as well as driving of the arm. Thus, the operability of combined arm-crowd and bucket operation can be improved, and the working efficiency of a work performed through this combined arm-crowd and bucket operation can be improved in comparison to the related art.

BRIEF DESCRIPTION OF THE DRAWINGS

Embodiments of the present invention will be described in detail based on the following drawings, wherein.

DETAILED DESCRIPTION OF THE INVENTION

Hereinbelow, a hydraulic drive device for a hydraulic excavator according to an embodiment of the present invention will be described with reference to the drawings.

Figure 1:
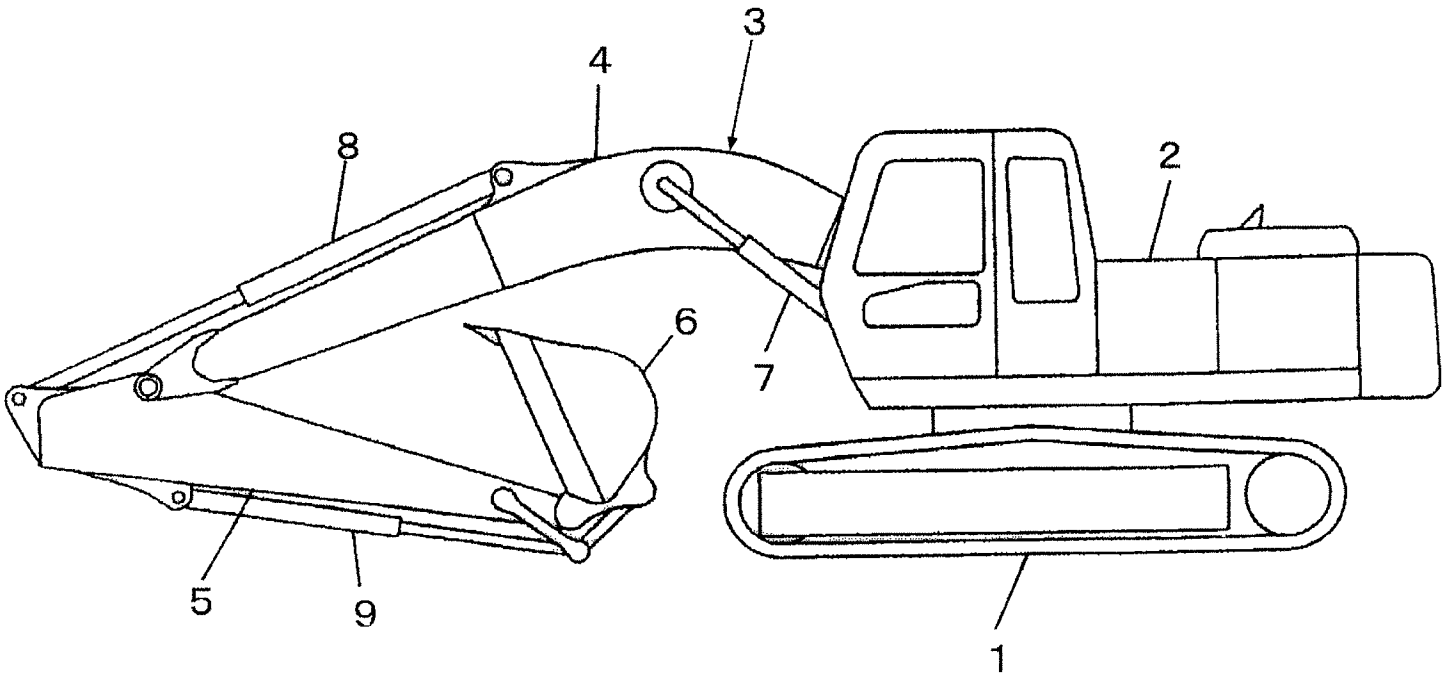
FIG. 1 is a side view of a hydraulic excavator equipped with a hydraulic drive device according to a first embodiment of the present invention.

As shown in FIG. 1, a hydraulic excavator equipped with a hydraulic drive device according to a first embodiment of the present invention includes a travelling body 1, a swing body 2 arranged on top of the travelling body 1, and a front attachment 3 that is connected to the swing body 2 so as to be vertically rotatable and performs work such as soil excavation or leveling, or work such as rolling for ground compaction. The front attachment 3 includes a boom 4 attached to the swing body, an arm 5 attached to the distal end of the boom 4, and a bucket 6 attached to the distal end of the arm 5. Also, the front attachment 3 includes a pair of boom cylinders 7 that drive the boom 4, an arm cylinder 8 that drives the arm 5, and a bucket cylinder 9 that drives the bucket 6.

Figure 2:
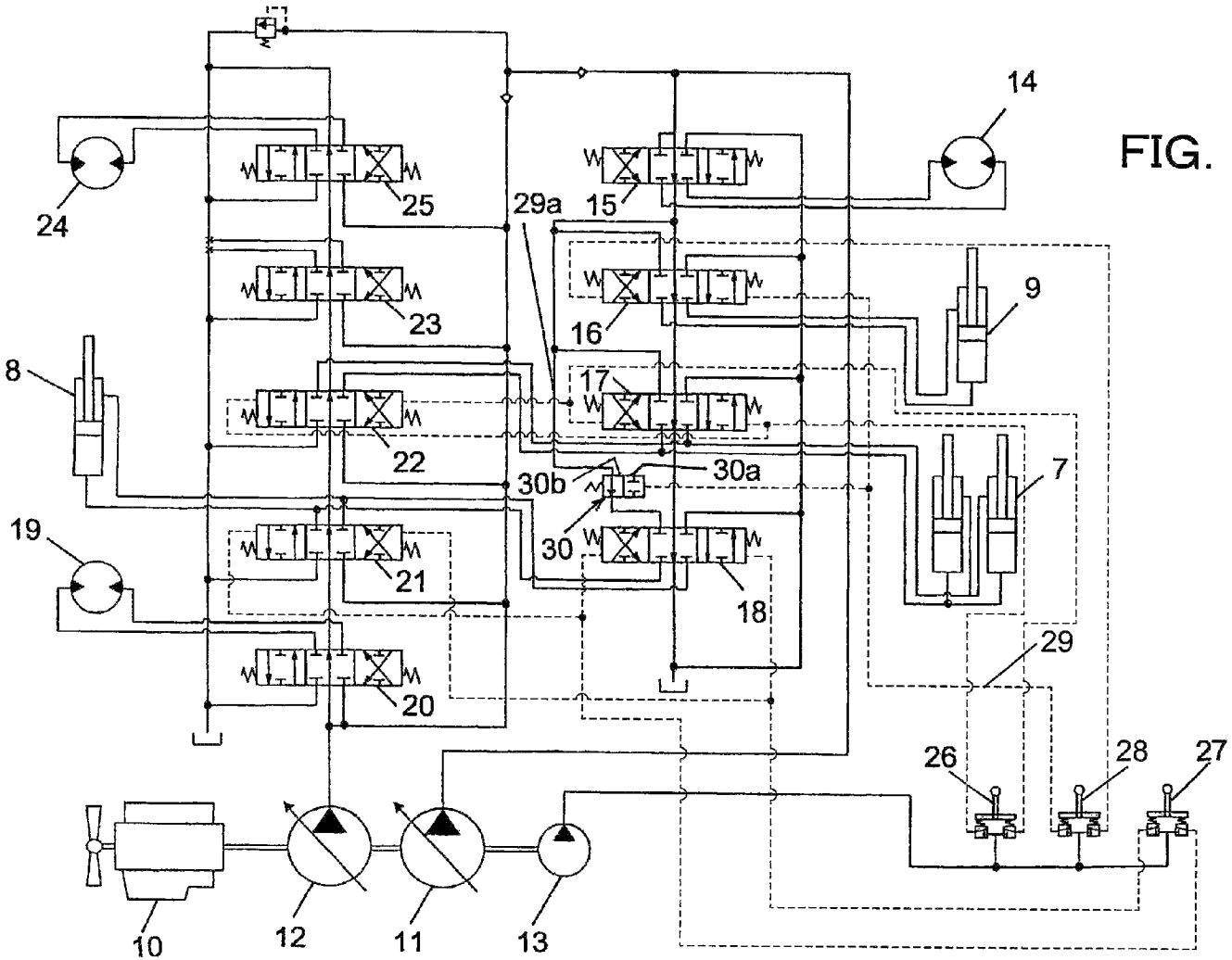
FIG. 2 is a hydraulic circuit diagram of the hydraulic drive device according to the first embodiment of the present invention.

As shown in FIG. 2, the hydraulic drive device according to the first embodiment of the present invention equipped to the hydraulic excavator shown in FIG. 1 includes an engine 10, and a first hydraulic pump 11, a second hydraulic pump 12, and a pilot pump 13, which are of a variable displacement type and driven by the engine 10.

Also, on the first hydraulic pump 11 side, there is provided a right-travel directional control valve 15 which is arranged on the most upstream side, and controls the flow of pressure oil supplied to a right travel motor 14 that drives the travelling body 1. Also, there are provided a bucket directional control valve 16, a first boom directional control valve 17, and a second arm directional control valve 18, which are connected downstream of the right-travel directional control valve 15 and each connected in parallel tandem with the first hydraulic pump 11. The bucket directional control valve 16 controls the flow of pressure oil supplied to the bucket cylinder 9. The first boom directional control valve 17 controls the flow of pressure oil supplied to the boom cylinder 7. The second arm directional control valve 18 controls the flow of pressure oil supplied to the arm cylinder 8.

Also, on the second hydraulic pump 12 side, there are provided a swing directional control valve 20, a first arm directional control valve 21, a second boom directional control valve 22, a spare directional control valve 23, and a left-travel directional control valve 25, which are each connected in parallel tandem with the second hydraulic pump 12. The swing directional control valve 20 controls the flow of pressure oil supplied to a swing motor 19 that swings the swing body 2. The first arm directional control valve 21 controls the flow of pressure oil supplied to the arm cylinder 8. The second boom directional control valve 22 controls the flow of pressure oil supplied to the boom cylinder 7. The left-travel directional control valve 25 controls the flow of pressure oil supplied to a left travel motor 24 that drives the travelling body 1.

Also, the hydraulic drive device according to the first embodiment includes a boom operating device 26 that performs a switch operation of the first boom directional control valve 17 and the second boom directional control valve 22, an arm operating device 27 that performs a switch operation of the first arm directional control valve 21 and the second arm directional control valve 18, and a bucket operating device 28 that performs a switch operation of the bucket directional control valve 16.

The hydraulic drive device according to the first embodiment of the present invention includes a flow rate restriction device that restricts the flow rate of pressure oil supplied to the second arm directional control valve 18 during operation of the bucket 6, for example, during crowd operation of the bucket 6. This flow rate restriction device is provided in, for example, a bypass path 29*a* connecting to the supply port of the second arm directional control valve 18. The flow rate restriction device includes a variable throttle 30 whose opening is controlled to become smaller with operation of the bucket operating device 28 to the crowd side, and a passage 29 that guides pilot pressure supplied from the pilot pump 13 to a control portion of the variable throttle 30 as the bucket operating device 28 is operated to the crowd side. The variable throttle 30 described above is held in such a way that its opening becomes maximum due to a spring force when pilot pressure is not applied to its control portion.

In the first embodiment configured in this way, during independent operation of the bucket 6, following a switch operation with the bucket operating device 28, the bucket directional control valve 16 is switched, pressure oil in the first hydraulic pump 11 is supplied to the bucket cylinder 9 via the bucket directional control valve 16, and the bucket cylinder 9 is actuated, thereby performing an independent crowd operation or independent dump operation of the bucket 6.

When an independent crowd operation of the bucket 6 is performed, pilot pressure supplied from the pilot pump 13 is supplied to the control portion of the variable throttle 30 via the passage 29. When the force due to the pilot pressure becomes greater than the spring force of the variable throttle 30, the variable throttle 30 is switched to a right position 30*a*, and its opening is controlled to become smaller so that the flow rate of pressure oil supplied to the second arm directional control valve 18 becomes lower. However, since the current operation is an independent crowd operation of the bucket 6, even if the opening of the variable throttle 30 is controlled to become smaller, the action of the bucket 6, and the action of the arm 5 are not affected.

Also, during independent operation of the arm 5, following a switch operation with the arm operating device 27, the first arm directional control valve 21 and the second arm directional control valve 18 are switched, the arm cylinder 8 is actuated, and an independent crowd operation or independent dump operation of the arm 5 is performed. At this time, the variable throttle 30 has been switched into a left position 30*b* by its spring force to keep the opening maximum. Thus, pressure oil in the first hydraulic pump 11 is supplied to the arm cylinder 8 via the variable throttle 30 and the second arm directional control valve 18, and pressure oil in the second hydraulic pump 12 is supplied to the arm cylinder 8 via the first arm directional control valve 21. That is, the arm cylinder 8 is actuated by the pressure oil in each of the first hydraulic pump 11 and the second hydraulic pump 12, thereby performing an independent crowd operation or independent dump operation of the arm 5 as described above.

Then, during combined operation of arm-crowd or arm-dump, and bucket-dump, in accordance with the relative sizes of the load pressure on the arm 5 and the load pressure on the bucket 6, pressure oil in the first hydraulic pump 11 is supplied to the bucket cylinder 9 via the bucket directional control valve 16, and supplied to the arm cylinder 8 via the second arm directional control valve 18, for example, and pressure oil in the second hydraulic pump 12 is supplied to the arm cylinder 8 via the first arm directional control valve 21. Through these processes, a combined operation of arm-crowd or arm-dump, and bucket-dump is performed.

Also, during combined operation of arm-crowd or arm-dump, and bucket-crowd, as described above, as the bucket operating device 28 that performs a crowd operation of the bucket 6 is operated to the crowd side, pilot pressure supplied from the pilot pump 13 is supplied to the control portion of the variable throttle 30 via the passage 29. When the force due to the pilot pressure becomes greater than the spring force of the variable throttle 30, the variable throttle 30 is switched to the right position 30*a*, and its opening is controlled to become smaller so that the flow rate of pressure oil supplied to the second arm directional control valve 18 becomes lower.

Therefore, the pressure in the bypass path 29*a* connecting to the supply port of the second arm directional control valve 18 becomes high, and pressure oil supplied from the first hydraulic pump 11 is mainly supplied to the bucket cylinder 9 via the bucket directional control valve 16. Also, pressure oil discharged from the second hydraulic pump 12 is supplied to the arm cylinder 8 via the first arm directional control valve 21. Through these processes, both the bucket 6 and the arm 5 are driven, thereby allowing a combined operation of arm-crowd or arm-dump, and bucket-crowd to be performed in a satisfactory manner.

With the hydraulic drive device according to the first embodiment configured as described above, even during combined arm-crowd and bucket-crowd operation when the load pressure on the arm 5 sometimes becomes lower than the load pressure on the bucket 6 as in the case of soil leveling work, sand excavation work, or the like, the flow rate of pressure oil supplied to the second arm directional control valve 18 is restricted by actuation of the variable throttle 30 as described above. Thus, pressure oil in the first hydraulic pump 11 tends to be supplied mainly to the bucket directional control valve 16, and pressure oil in the second hydraulic pump 12 is supplied to the first arm directional control valve 21. This allows both the arm cylinder 8 and the bucket cylinder 9 to be actuated to achieve smooth driving of the bucket 6 as well as driving of the arm 5, thereby improving the operability of combined arm-crowd and bucket-crowd operation. In addition, the working efficiency of a leveling work, a sand excavation work, and the like performed through this combined arm-crowd and bucket-crowd operation can be improved.

Figure 3:
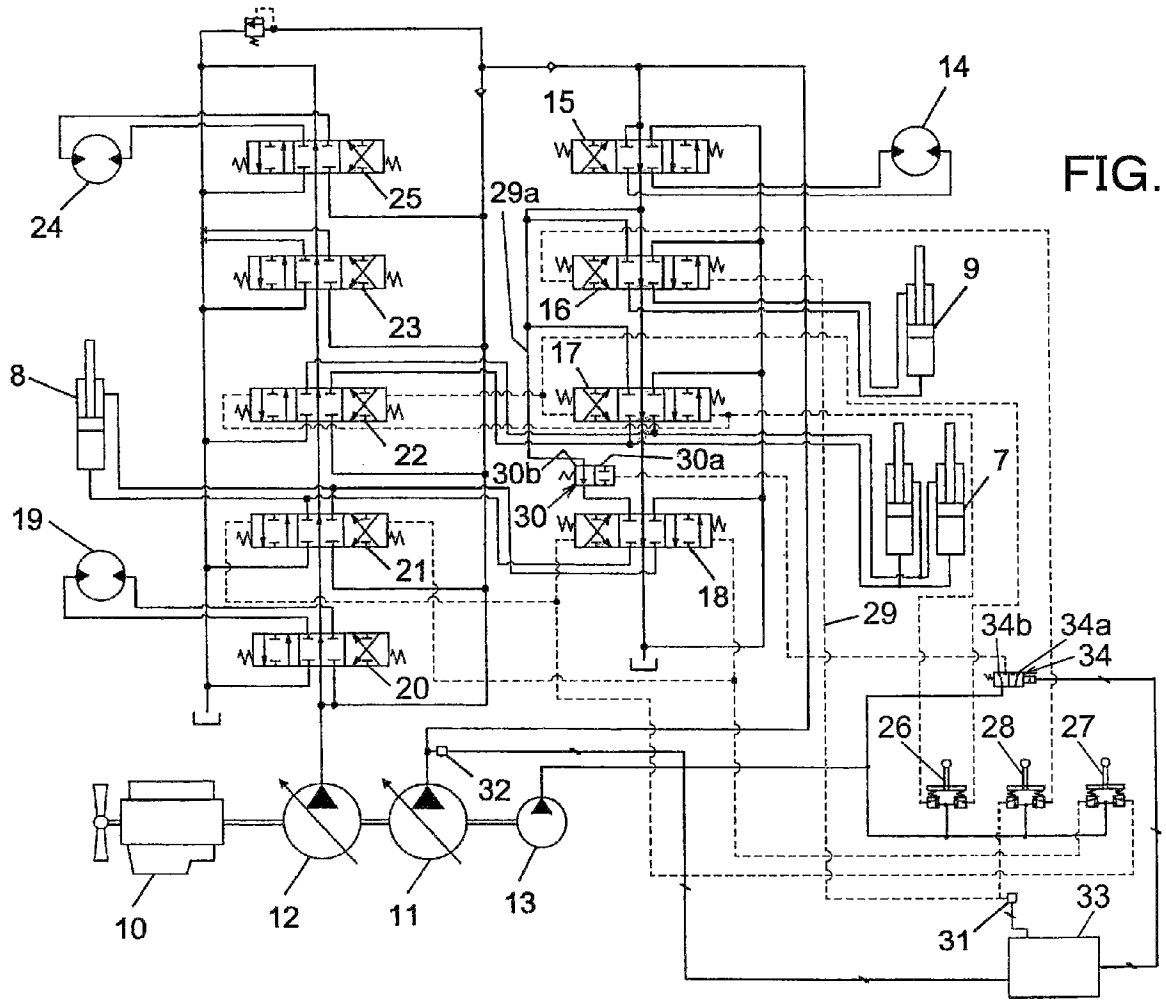
FIG. 3 is a hydraulic circuit diagram of a hydraulic drive device according to a second embodiment of the present invention.

A hydraulic drive device according to a second embodiment of the present invention shown in FIG. 3 is also equipped to, for example, the above-described hydraulic excavator 1 shown in FIG. 1. The hydraulic drive device according to the second embodiment includes a pressure sensor 31 that detects the amount of operation when operating the bucket operating device 28 to the crowd side, as bucket-crowd Pi pressure. Also, the hydraulic drive device includes a controller 33 that determines whether or not the amount of operation detected by the pressure sensor 31 is a predetermined amount or more, in other words, whether or not the amount of operation corresponds to a predetermined bucket-crowd Pi pressure or more, and outputs an actuation signal for actuating the variable throttle 30 when the amount of operation corresponds to the predetermined bucket-crowd Pi pressure or more. Also, the hydraulic drive device includes an electromagnetic switching valve 34. The electromagnetic switching valve 34 is switched so as to allow communication between the pilot pump 13 and the passage 29 connecting to the control portion of the variable throttle 30 when an actuation signal is outputted from the controller 33, in other words, when the maximum value of target output is outputted as will be described later, and is switched so as to shut off the communication between the pilot pump 13 and the passage 29 when an actuation signal is not outputted from the controller, in other words, when the minimum value of target output is outputted as will be described later.

Also, the hydraulic drive device according to the second embodiment also includes a discharge pressure sensor 32 that detects the pressure of pressure oil discharged from the first hydraulic pump 11, and outputs the detected pressure to the controller 33.

Figure 4:
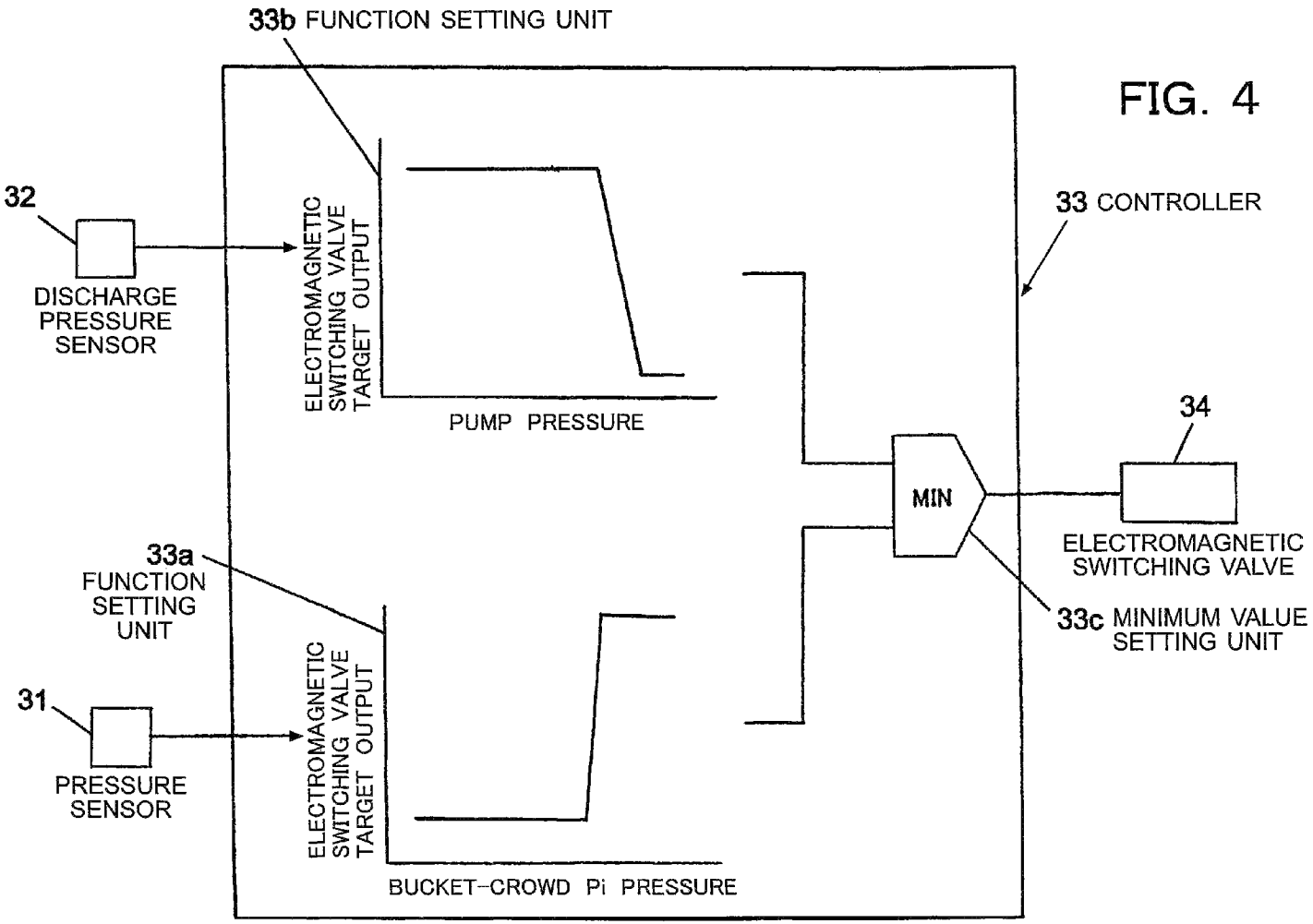
FIG. 4 is a block diagram showing the configuration of the main portion of a controller included in the hydraulic drive device according to the second embodiment.

As shown in FIG. 4, the controller 33 is provided with function setting units 33*a* and 33*b*, and a minimum value selecting unit 33*c* that selects the minimum value of target output of the electromagnetic switching valve 34 outputted from each of the function setting units 33*a* and 33*b*, and outputs the minimum value to the electromagnetic switching valve 34.

In the function setting unit 33*a*, the relationship between bucket-crowd Pi pressure outputted from the pressure sensor 31 described above, and the target output to the electromagnetic switching valve 34 is set. When bucket-crowd Pi pressure is equal to or higher than a predetermined pressure, in other words, when it is determined that the amount of operation of the bucket operating device 28 is equal to or larger than a predetermined amount, the function setting unit 33*a* outputs the maximum value of target output, in other words, an actuation signal to the electromagnetic switching valve 34. When bucket-crowd Pi pressure is less than the predetermined pressure, in other words, when it is determined that the amount of operation of the bucket operating device 28 is less than the predetermined amount, the function setting unit 33*a* performs a control not to output an actuation signal, in other words, a control to output the minimum value of target output to the electromagnetic switching valve 34.

In the function setting unit 33*b*, the relationship between the pressure of pressure oil in the hydraulic pump 11 outputted from the discharge pressure sensor 32, in other words, the pump pressure, and the target output to the electromagnetic switching valve 34 is set. The function setting unit 33*b* performs a control to output the minimum value of target output of the electromagnetic switching valve 34 to the minimum value selecting unit 33*c* when the discharge pressure of the first hydraulic pump 11, in other words, the pump pressure becomes a predetermined high pressure or more, for example, a relief pressure.

The pressure sensor 31, the function setting unit 33*a* and the minimum value selecting unit 33*c* provided to the controller, the electromagnetic switching valve 34, the variable throttle 30, and the passage 29 described above constitute the flow rate restriction device that restricts the flow rate of pressure oil supplied to the second arm directional control valve 18, during crowd operation of the bucket 6.

Also, the discharge pressure sensor 32, the function setting unit 33*b* and minimum value setting unit 33*c* of the controller 33, and the electromagnetic switching valve 34 described above constitute a disable control device that performs a control to disable the restriction of flow rate by the flow rate restriction device described above, when the pressure of pressure oil discharged from the first hydraulic pump 11 becomes equal to the relief pressure, during crowd operation of the bucket 6.

Otherwise, the configuration of the second embodiment is the same as, for example, the hydraulic drive device according to the first embodiment described above.

In the hydraulic drive device according to the second embodiment configured in this way, during independent operation of the bucket 6, following a switch operation with the bucket operating device 28, the bucket directional control valve 16 is switched, pressure oil in the first hydraulic pump 11 is supplied to the bucket cylinder 9 via the bucket directional control valve 16, and the bucket cylinder 9 is actuated to thereby perform an independent crowd operation or independent dump operation of the bucket 6. When an independent crowd operation of the bucket 6 is performed, bucket-crowd Pi pressure detected by the pressure sensor 31 is inputted to the function setting unit 33*a* of the controller 33, and whether or not bucket-crowd Pi pressure is equal to or higher than a predetermined pressure is determined in the function setting unit 33*a*. When it is determined that bucket-crowd Pi pressure is equal to or higher than a predetermined pressure, the maximum value of target output of the electromagnetic switching valve 34 is outputted to the minimum value selecting unit 33*c*, and when it is determined that bucket-crowd Pi pressure is less than a predetermined pressure, for example, the minimum value of target output of the electromagnetic switching valve 34 is outputted to the minimum value selecting unit 33*c*.

In the meanwhile, the discharge pressure of the first hydraulic pump 11 is detected by the discharge pressure sensor 32, and the detected discharge pressure, in other words, the pump pressure is inputted to the function setting unit 33*b* of the controller 33. It is determined in the function setting unit 33*b* whether or not the pump pressure has reached the relief pressure. When it is determined in this determination that the pump pressure has not reached the relief pressure, for example, the maximum value of target output of the electromagnetic switching valve 34 is outputted to the minimum value selecting unit 33*c*, and when it is determined that the pump pressure has reached the relief pressure, the minimum value of target output of the electromagnetic switching valve 34 is outputted to the minimum value selecting unit 33*c*.

Now, assume that when in the crowd operation of the bucket 6 described above, it is determined that the pump pressure of the first hydraulic pump 11 has not reached the relief pressure, and the maximum value of target output of the electromagnetic switching valve 34 is outputted from the function setting unit 33*b* to the minimum value setting unit 33*c*. At this time, the value of target output selected by the minimum value selecting unit 33*c* is the maximum value of the target output to the electromagnetic switching valve 34, and in accordance with this maximum value, the electromagnetic switching valve 34 is switched to the right position 34*a*, thereby allowing communication between the pilot pump 13 and the passage 29 shown in FIG. 3.

Therefore, the pilot pressure of the pilot pump 13 is supplied to the control portion of the variable throttle 30 via the electromagnetic switching valve 34 and the passage 29. When the force due to the pilot pressure becomes greater than the spring force of the variable throttle 30, the variable throttle 30 is switched into the right position 30*a*, and its opening is controlled so as to become smaller. However, since the current operation is an independent crowd operation of the bucket 6, the action of the bucket 6 and the action of the arm 5 are not affected even if the opening of the variable throttle 30 is controlled so as to become smaller.

The actions during independent operation of the arm 5, and during combined operation of arm-crowd or arm-dump, and bucket-dump are the same as those in the first embodiment described above.

Also, when in the combined operation of arm-crowd or arm-dump, and bucket-crowd, in the state in which the pressure detected by the pressure sensor 32 has not reached the relief pressure, as described above, as the bucket operating device 28 that performs a crowd operation of the bucket 6 is operated to the crowd side, a detection signal is outputted from the pressure sensor 31 to the controller 33, an actuation signal is outputted from the controller 33 to the electromagnetic switching valve 34, and the electromagnetic switching valve 34 is switched into the right position 34*a*. Therefore, pilot pressure supplied from the pilot pump 13 is supplied to the control portion of the variable throttle 30 via the electromagnetic switching valve 34 and the passage 29. When the force due to the pilot pressure becomes greater than the spring force of the variable throttle 30, the variable throttle 30 is switched into the right position 30*a*, and its opening is controlled so as to become smaller so that the flow rate of pressure oil supplied to the second arm directional control valve 18 becomes lower.

Therefore, as in the first embodiment described above, the pressure in the bypass path 29*a* connecting to the supply port of the second arm directional control valve 18 becomes high, and pressure oil discharged from the first hydraulic pump 11 is mainly supplied to the bucket cylinder 9 via the bucket directional control valve 16. Also, pressure oil discharged from the second hydraulic pump 12 is supplied to the arm cylinder 8 via the first arm directional control valve 21. Through these processes, both the bucket 6 and the arm 5 are driven, thereby allowing a combined operation of arm-crowd or arm-dump, and bucket-crowd to be performed in a satisfactory manner.

Also, for example, when the discharge pressure of the first hydraulic pump 11 detected by the pressure sensor 32, in other words, the pump pressure becomes equal to the relief pressure while the combined operation of arm-crowd or arm-dump, and bucket-crowd is performed as described above, in the function setting unit 33*b* of the controller 33, the target output of the electromagnetic switching valve 34 becomes the minimum value. Therefore, this minimum value is selected by the minimum value selecting unit 33*c*, and is outputted to the electromagnetic switching valve 34 as the target output. Thus, the electromagnetic switching valve 34 is switched into the left position 34*b* by its spring force, thereby shutting off communication between the pilot pump 13 and the passage 29. Following this, pilot pressure is no longer supplied to the passage 29, and the variable throttle 30 is switched into the left position by its spring force. This disables the restriction of the flow rate of pressure oil supplied to the second arm directional control valve 18, thereby actively permitting the supply of pressure oil to the second arm directional control valve 18. Therefore, pressure oil in the first hydraulic pump 11 is supplied to the second arm directional control valve 18, and actively used for actuation of the arm cylinder 8.

In the hydraulic drive device according to the second embodiment configured in this way as well, during combined arm-crowd and bucket-crowd operation, pressure oil in the first hydraulic pump 11 tends to be supplied mainly to the bucket directional control valve 16, and pressure oil in the second hydraulic pump 12 is supplied to the first arm directional control valve 21. This allows both the arm cylinder 8 and the bucket cylinder 9 to be actuated to enhance the operability of combined operation of arm-crowd and bucket-crowd, thereby providing the same effect as that in the first embodiment.

Also, when, during combined operation of arm-crowd and bucket-crowd, the pressure of pressure oil discharged from the first hydraulic pump 11 becomes equal to a predetermined high pressure, for example, the relief pressure, pressure oil in the first hydraulic pump 11, which has been so far mainly supplied to the bucket directional control valve 16, is supplied also to the second arm directional control valve 18, thereby achieving effective use of drive energy to ensure good economy.

It should be noted that while the first embodiment and the second embodiment described above are configured so that the flow rate restriction device that restricts the flow rate of pressure oil supplied to the second arm directional control valve 18 is provided in association with a crowd operation of the bucket 6. However, the flow rate restriction device may be provided in association with a dump operation of the bucket 6. This configuration makes it possible to improve the operability of combined arm-crowd and bucket-dump operation. In addition, the working efficiency of a rolling work or the like performed through this combined arm-crowd and bucket-dump operation, in other words, rolling work or the like for ground compaction can be improved.

Also, the second embodiment described above is configured to include the disable control device that performs a control to disable the restriction of flow rate by the flow rate restriction device when the pressure of pressure oil discharged from the first hydraulic pump 11 becomes equal to the relief pressure, during crowd operation of the bucket 6. However, the second embodiment may be configured to include a disable control device that performs a control to disable the restriction of flow rate by the flow rate restriction device when the pressure of pressure oil discharged from the first hydraulic pump 11 becomes equal to the relief pressure, during dump operation of the bucket 6.

Also, the first embodiment described above may be configured to include a device that switches the variable throttle 30 provided in the hydraulic drive device according to the first embodiment into the left position 30*b* in which the opening becomes maximum, in other words, a disable control device that performs a control to disable the restriction of flow rate by the flow rate restriction device when the pressure of pressure oil in the first hydraulic pump 11 becomes equal to a predetermined high pressure such as the relief pressure, during combined arm-crowd and bucket-crowd operation, or during combined arm-crowd and bucket-dump operation.

What is claimed is:

1. A hydraulic drive device for a hydraulic excavator, which is provided in the hydraulic excavator including a front attachment, the front attachment being connected to a swing body in a vertically rotatable manner and including an arm, a bucket, an arm cylinder, and a bucket cylinder, comprising:

an engine;

a first hydraulic pump, a second hydraulic pump, and a pilot pump that are driven by the engine;

a bucket directional control valve and a second arm directional control valve that are each connected in parallel tandem with the first hydraulic pump, the bucket directional control valve controlling a flow of pressurized oil supplied to the bucket cylinder, the second arm directional control valve controlling a flow of pressurized oil supplied to the arm cylinder;

a swing directional control valve and a first arm directional control valve that are each connected in parallel tandem with the second hydraulic pump, the swing directional control valve controlling a flow of pressurized oil supplied to a swing motor for rotating the swing body, and the first arm directional control valve controlling a flow of pressurized oil supplied to the arm cylinder;

a flow rate restriction device that restricts a flow rate of pressurized oil supplied to the second arm directional control valve; and a disable control device that performs a control to disable the restriction of the flow rate by the flow rate restriction device when a pressure of pressurized oil discharged from the first hydraulic pump becomes a high pressure equal to or higher than a predetermined pressure regardless of each operation status of the crowd operation of the bucket and the crowd operation of the arm and swing operation of the swing body, wherein the flow rate restriction device, when not disabled, restricts the flow rate of pressurized oil supplied to the second arm directional control valve is during crowd operation of the bucket so that a combined operation of arm-crowd and bucket-crowd is achieved.

2. The hydraulic drive device for a hydraulic excavator according to claim 1, further comprising:

a bucket operating device that performs a switch operation of the bucket directional control valve, wherein the flow rate restriction device includes a variable throttle whose opening is controlled to become smaller to restrict the flow rate of pressure oil supplied to the second arm directional control valve, the variable throttle being provided in a bypass path that connects to a supply port of the second arm directional control valve.

3. The hydraulic drive device for a hydraulic excavator according to claim 2, wherein the flow rate restriction device includes a passage that guides a pilot pressure supplied from the pilot pump to a control portion of the variable throttle, in accordance with the crowd operation of the bucket.

4. The hydraulic drive device for a hydraulic excavator according to claim 3 , wherein the flow rate restriction device includes:

a pressure sensor that detects an amount of operation of the bucket operating device during the crowd operation of the bucket;

a controller that determines whether or not the amount of operation detected by the pressure sensor is equal to or larger than a predetermined amount, and outputs an actuation signal for actuating the variable throttle when the amount of operation is equal to or more than the predetermined amount and when the flow rate restriction device is not disabled; and an electromagnetic switching valve that is switched to allow communication between the pilot pump and the passage when the actuation signal is outputted from the controller, and is switched to shut off communication between the pilot pump and the passage when the actuation signal is not outputted from the controller.

* * * * *